US005725139A

United States Patent [19]

Smith

[11] Patent Number: 5,725,139

[45] Date of Patent: Mar. 10, 1998

[54] BACKPACK WITH ADJUSTMENTS FOR BODY SIZE

[75] Inventor: Patrick D. Smith, Golden, Colo.

[73] Assignee: Mountainsmith, Inc., Golden, Colo.

[21] Appl. No.: 291,587

[22] Filed: Aug. 15, 1994

[51] Int. Cl.[6] ..... A45F 3/08

[52] U.S. Cl. ..... 224/637; 224/631; 224/638

[58] Field of Search ..... 224/204, 209, 224/210, 211, 212, 213, 214, 215, 216, 259, 262, 263, 264, 627, 631, 632, 633–636, 637–641; 2/311, 328, 267

[56] References Cited

U.S. PATENT DOCUMENTS

| | | | |
|---|---|---|---|
| 2,914,070 | 11/1959 | Kellner et al. | 2/311 |
| 3,685,155 | 8/1972 | Oblander | 2/311 |
| 4,029,243 | 6/1977 | Zerobnick et al. . | |
| 4,332,379 | 6/1982 | Bannister . | |
| 4,449,654 | 5/1984 | Cappis | 224/148 |
| 4,545,414 | 10/1985 | Baum . | |
| 5,025,965 | 6/1991 | Smith | 224/151 |
| 5,157,789 | 10/1992 | Klass | 2/267 |
| 5,181,638 | 1/1993 | McHale | 224/262 |
| 5,183,194 | 2/1993 | Shirdavani | 224/642 |
| 5,184,764 | 2/1993 | Orovan et al. | 224/637 |
| 5,228,609 | 7/1993 | Gregory | 224/907 |
| 5,240,159 | 8/1993 | Gregory | 224/209 |

FOREIGN PATENT DOCUMENTS

| | | | |
|---|---|---|---|
| 570192 | 11/1993 | European Pat. Off. | 224/211 |
| 2677235 | 12/1992 | France | 224/209 |
| 3844675 | 6/1990 | Germany | 224/211 |
| 9105493 | 5/1991 | WIPO | 224/215 |

OTHER PUBLICATIONS

Mountainsmith Product Brochure, title and author unknown. Instructions Manual for Mountainsmith Alpine Series Packs, author unknown, printed by Mountainsmith Catalogue printed by Osprey of Dolores, Colorado entitled "Osprey Packs 1994", Michael Pfotenhauer, author.

*Primary Examiner*—Henry J. Recla
*Assistant Examiner*—Gregory M. Vidovich
*Attorney, Agent, or Firm*—Robert G. Crouch; Chrisman, Bynum & Johnson, P.C.

[57] ABSTRACT

A backpack includes a waistbelt system with a pocket formed by a pair of longitudinally extending spaced-apart flexible straps for receiving the hipbone of the user. The pocket is formed by a pair of longitudinally extending spaced-apart flexible strap. One of the longitudinally extending horizontal straps on either side of the waistbelt system is adjustable so that each separate side of the waistbelt system can be tilted to fit users having large hips or stomachs. A pair of hip cushions are provided on the waistbelt system, one on either side, which are connected to the remainder of the waistbelt system in a manner which allows relative movement between the hip cushion and the waistbelt assembly to reduce frictional forces upon the user. A shoulder width-adjustment system includes a spring bias member and an adjustment strap which allows a pair of shoulder strap support members to be adjusted to the desired shoulder width. The backpack includes a shoulder strap system with variable-length shoulder which are adjustable relative to a buckle wherein the strap may be precisely positioned relative to the buckle with the use of an index scale with height indicating indicia thereon placed on the shoulder strap. The height indicating indicia of the system includes indicia for body height and torso height.

10 Claims, 6 Drawing Sheets

BACKPACK WITH ADJUSTMENTS FOR BODY SIZE

BACKPACK WITH ADJUSTMENTS FOR BODY SIZE

This invention relates to an improved backpack with a variety of adjustments to fit the particular body size of the user, particularly to a backpack with adjustments for the particular body height, torso height, shoulder width, waist-size, and hip-shape of the user and with improved features to increase the user's comfort.

BACKGROUND OF THE INVENTION

The term "backpacks" can include traditional backpacks having a pair of shoulder straps and possibly a waistbelt. Backpacks can also include variations known as fannypacks and lumbar packs having only a waistbelt and no shoulder straps. In the past, backpacks were sold in separate sizes for differently sized users. More recently, adjustable backpacks have been produced to accommodate a range of differently sized users. With such backpacks, both the waistbelt and the shoulder straps are typically adjustable in length to accommodate different users. Some of the relevant areas in which a user's body size may vary include torso height, shoulder width, chest and shoulder size, waist-size, and waist/hip shape.

As adjustable backpacks and strap/belt systems become more complex, it is not easily apparent to the user whether or not the backpack is properly adjusted and, more importantly, it is not easily apparent how to make the necessary adjustments. Trained personnel, however, particularly those at retail outlets selling backpacking equipment, are capable of recognizing the need for and making the proper adjustments. However, it would be preferable for backpacks to be adjustable in a manner which could be easily made by the user throughout the life of the backpack without trained assistance and, to the extent possible, while the backpack is on the back of the user.

Even when properly adjusted, users may find backpacks to be relatively uncomfortable after long and repeated use. This is largely a result of weight-bearing forces and frictional forces from the backpack being applied to the areas on the user's body supporting the backpack. These areas include the shoulders and the hips at the points where they contact the shoulder straps and waistbelt, respectively. The entire weight of a loaded backpack applied to small points on the hipbones and on the shoulders may cause pain and discomfort. The movement of the load in the backpack relative to the body of the user may cause portions of the waistbelt and shoulder straps to move relative to the user's body, possibly causing chafing and additional discomfort. Further, waistbelts are designed so as to mate with a waist and hip shape which is fairly uniform along a vertical axis. This shape, however, is not consistent with the wide variety of waist and hip shapes of the users who may wear backpacks. For example, persons with large hips or large stomachs have surfaces which diverge from the vertical axis. In this situation, the above-described shape of the waistbelt will cause the weight-bearing force to be applied to a relatively smaller area of the user's waist and hips.

SUMMARY OF THE INVENTION

Accordingly, it is an object of the present invention to provide a backpack with a waistbelt which eliminates or greatly reduces the amount of pressure placed upon the hipbone of the user.

It is another object of this invention to provide an improved waistbelt system for a backpack which can be tilted through an infinite number of angles to fit the particular waist-and hip-shape of the user.

It is still another object of this invention to provide a tillable waistbelt system for a backpack in which the separate sides of the waistbelt can be tilted at different angles from each other so as to accommodate asymmetrical hip-shapes.

It is another object of this invention to provide an improved waistbelt for backpack in which the forces are spread vertically across substantially the entire height of the waistbelt so as to reduce the pressure at a central portion thereof.

It is still further an object of this invention to provide a backpack with shoulder straps with an improved system for adjusting the width between the shoulder straps to accommodate a range of differently sized users.

It is another object of this invention to provide an improved backpack in which the length and position of the shoulder straps is easily adjustable to the proper length and position for a wide range of differently sized users.

It is still further an object of this invention to provide an improved waistbelt system for a backpack in which the sliding forces caused by movement of the user and load in the backpack are virtually eliminated or reduced from impacting the user.

It is still further an object of this invention to provide an improved method of adjusting a backpack to properly fit a wide range of differently sized users.

Additional objects, advantages, and novel features of this invention shall be set forth in part in the description that follows, and in part will become apparent to those skilled in the art upon examination of the following description or may be learned by the practice of the invention. The objects and the advantages of the invention may be realized and attained by means of the instrumentalities and combinations particularly pointed out in the appended claims.

To achieve the foregoing and other objects and in accordance with the purposes of the present invention, as embodied and broadly described herein, the backpack with adjustments for body size of the present invention may include a pack with an improved waistbelt connected to the pack. The waistbelt includes features to define a pocket within the waistbelt which is positioned to receive the hipbone of the user. This pocket serves to relieve the pressure of the waistbelt on the user's hip-bone and thus to increase the comfort level of wearing such a backpack. A pair of longitudinally-extending spaced-apart straps are provided so that the facing edges of the two straps are longer than the opposite edges of the two straps so that a pocket is naturally defined therebetween.

Another aspect of the backpack of the present invention includes a pack with an improved waistbelt system which may be independently tilted on either of the two sides corresponding to the user's hips. On each side of the waistbelt are a pair of longitudinally-extending spaced-apart straps in which one of the straps is adjustable relative to the other so as to tilt that section of the waistbelt. The adjustable straps are adjustable to an infinite number of lengths so as to provide an infinite number of tilt angles for the waistbelt.

Another aspect of the backpack of the present invention includes a pack connected to an improved waistbelt. The waistbelt includes a padded central portion which rests against the hips of the user and a pair of pliable attachment straps attached to the central portion at terminal ends thereof and selectively attachable together at free ends thereof. At the point where the terminal end of the attachment straps are attached to the central portion, a relatively stiff, vertically-extending support member is provided to transfer forces from the attachment straps vertically across substantially the entire height of the padded central portion of the waistbelt.

Another aspect of the backpack of the present invention includes a pack with a pair of shoulder straps attached to a pair of shoulder strap support members on the pack. An adjustable-length adjustment strap interconnects the pair of shoulder strap support members. A biasing means interconnects the pair of shoulder strap support members and is provided to bias the members away from each other to the extent allowed by the adjustment strap. The biasing means is a flexible rod which is biased to return toward a relaxed position.

Another aspect of the backpack of the present invention includes a pack with an upper and lower portion. The upper portion of the pack has a pair of strap connectors. A pair of shoulder straps are operatively connected between the upper and lower portions of the pack. The upper ends of each strap mates with one of the pair of strap connectors and each strap includes an index provided thereon for indicating the position of the strap relative to the connector. This allows the shoulder strap to be reliably and repeatably adjusted to the same position relative to the connectors. The index includes a scale which is indicative of the height of the user and/or the height of the torso of the user.

Further, a pair of shoulder straps support straps are provided to lift the top of the shoulder strap off of the top of the user's shoulder. Each support strap is connected to the upper portion of the backpack with a moveable connector. Each of the moveable connectors is moveable relative to the upper and lower portions of the pack along a height-adjustment strap which includes an index provided thereon for indicating the position of the height-adjustment strap relative to the moveable connector. This index for the moveable connector includes a scale indicative of the height of the user and/or the height of the torso of the user.

Another aspect of the backpack of the present invention includes a pack attached to an improved waistbelt system. The improved waistbelt system includes a supporting waistbelt which encircles the waist or torso of the user. Operatively connected to the supporting waistbelt is a padded support member which has an inner surface for bearing against the hip of the user. The supporting waistbelt and padded support member are free to move a limited amount relative to each other so that the padded support member may remain stationary relative to the user yet move relative to the supporting waistbelt. Two separate hip support members are provided, one for each of the hips of the user. Further, the padded support member is attached to the waistbelt at a first position and slidably received on the waistbelt at a second position.

The method of this invention includes the steps of determining the height of the user and adjusting the pair of adjustable shoulder straps relative to the corresponding strap connectors to a position which is indicative of the height of the user. This method includes the position of each of the straps relative to the connectors indicating the height of the user for which the height of the adjusted straps will properly fit. Further, each of the straps includes a height indicating scale thereon which may be read relative to the corresponding connector. The step of adjusting the pair of shoulder straps can be made relative to the torso height of the user. Alternatively, the step of adjusting the pair of shoulder straps can be made relative to the entire body height of the user while in the standing position.

BRIEF DESCRIPTION OF THE DRAWINGS

The accompanying drawings, which are incorporated in and form a part of the specifications, illustrate the preferred embodiments of the present invention, and together with the descriptions serve to explain the principles of the invention. In the drawings.

DETAILED DESCRIPTION OF THE PREFERRED EMBODIMENT

Figure 1:
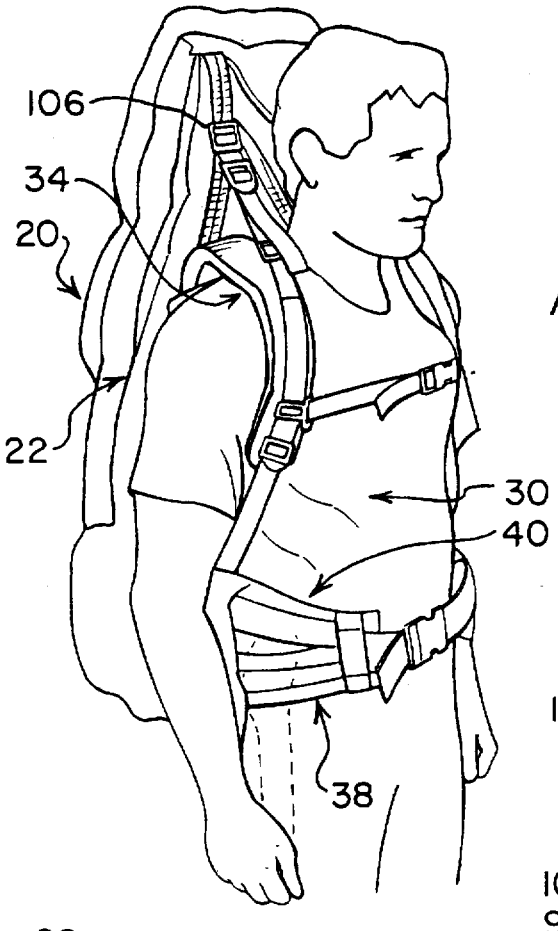
FIG. 1 is a perspective view of a user wearing the backpack of the present invention.
Figure 2:
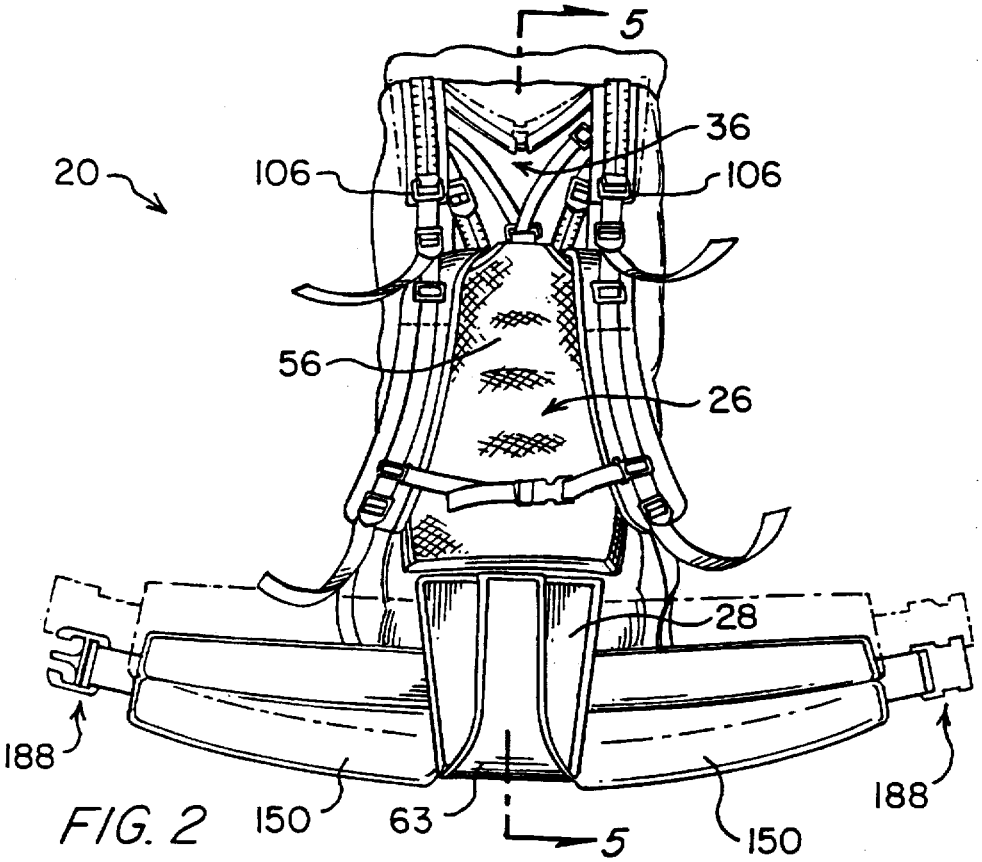
FIG. 2 is a rear elevation view of the backpack of FIG. 1.
Figure 6:
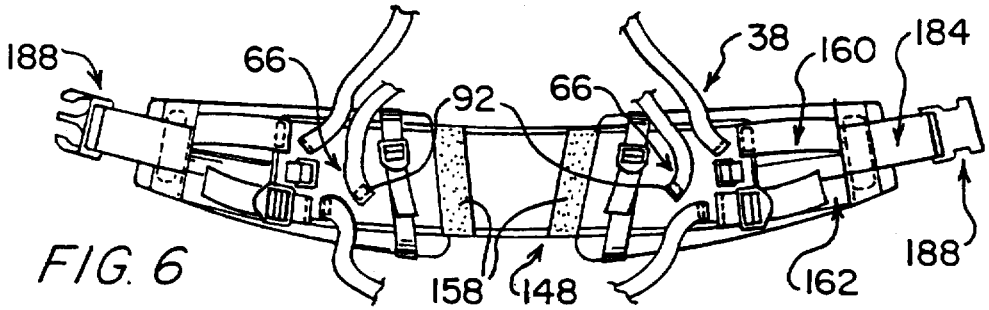
FIG. 6 is a front elevation view of the waistbelt of the backpack shown in FIG. 2.

The backpack 20 of the present invention, as shown in FIGS. 1 and 2, includes a bag or pack 22 for holding a plurality of objects (not shown), an aluminum frame 24 for supporting the pack, upper and lower pads 26 and 28, respectively, connected to the pack to provide a cushion between a user 30 and the backpack 20, a shoulder strap system 32 for carrying the backpack 20 on the user's shoulders 34, a shoulder width-adjustment system 36 for adjusting the shoulder width of the backpack 20, and a waistbelt system 38 for connecting the backpack 20 about the hips 40 of the user 30.

Figure 3:
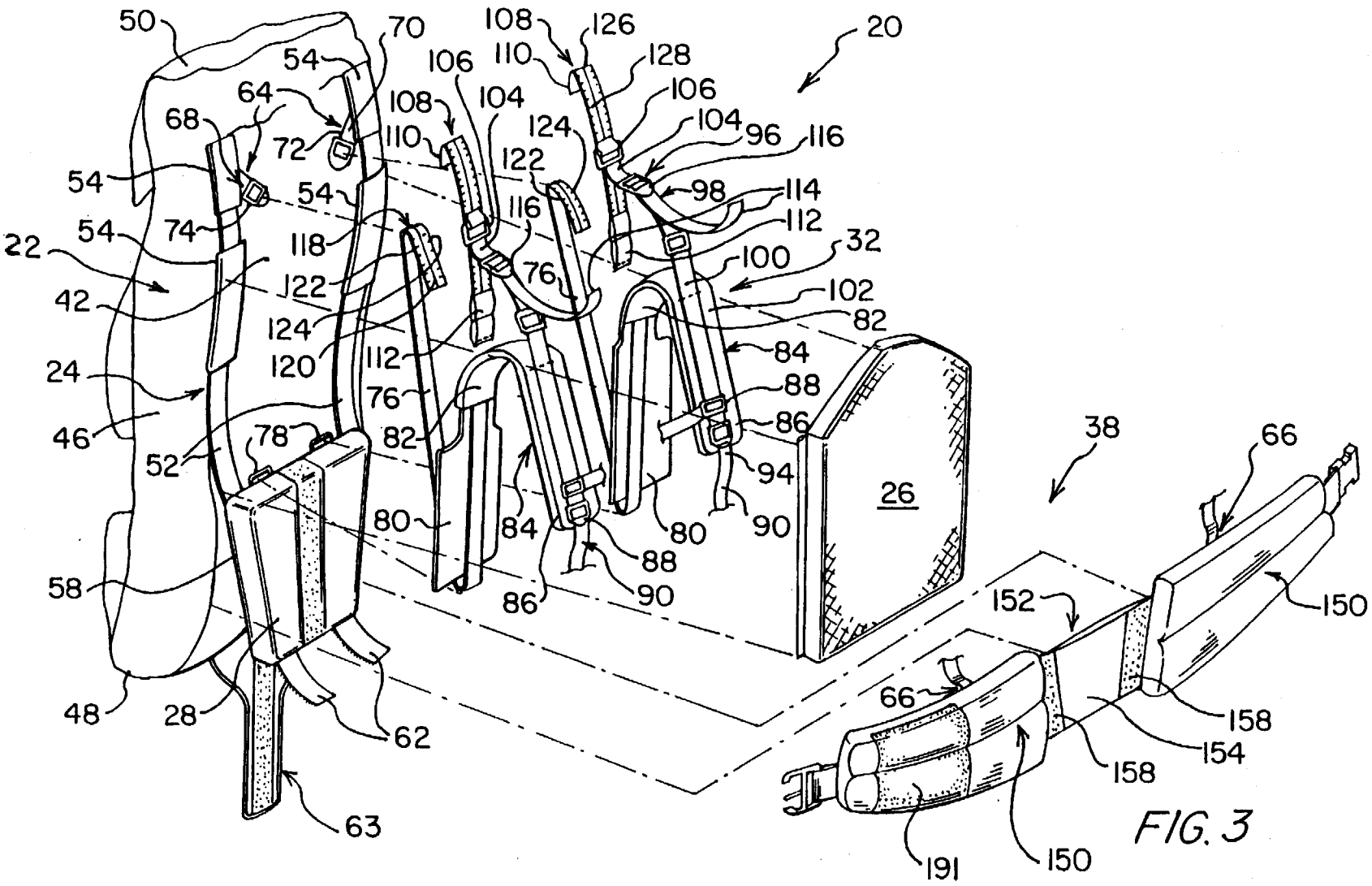
FIG. 3 is an exploded perspective view of the backpack of FIG. 1 showing the adjustable shoulder strap system and its attachment to the backpack.
Figure 5:
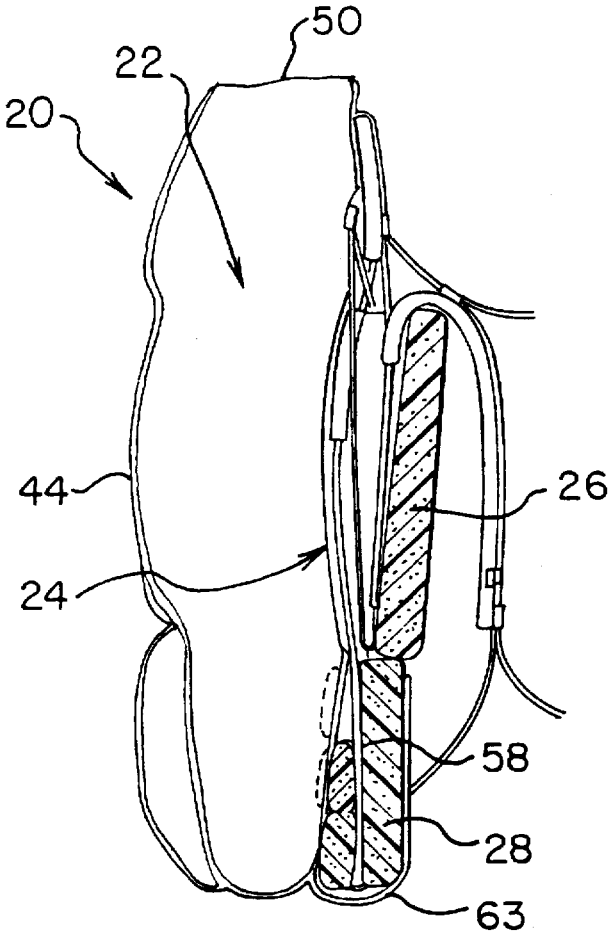
FIG. 5 is a cross-sectional view of the backpack taken along line 5—5 of FIG. 2 showing the shoulder strap system and the upper and lumbar pads which rest against the user.
Figure 8:
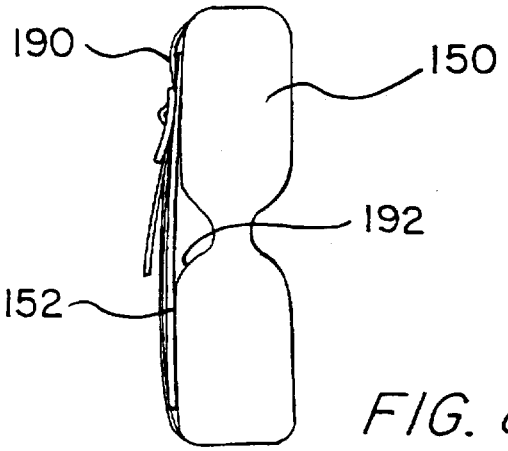
FIG. 8 is a cross-sectional view taken along line 8—8 of FIG. 7 showing the inner and outer sections of the waistbelt.

The pack 22, best seen in FIGS. 3 and 5, is a generally elongated, pliant-sided bag adapted to hold a variety of objects of different sizes and shapes. The pack 22 is preferably composed of a backpack-grade fabric, such as cordura or the like or high-tenacity two hundred-ten denier oxford cloth or better fabric. The pack 22 can be a top opening or front opening pack, as is well known in the art. The pack 22 includes a front panel 42, a back panel 44, a pair of side panels 46, a bottom panel 48 and a top panel 50. Further, the pack 22 may include a variety of internal and external pockets and straps for attachment to a variety of other packs and containers (none of which are shown).

The frame 24, best seen in FIGS. 3 and 5, includes a pair of elongated s-shaped aluminum bars 52. Each bar 52 is attached to the pack 22 by fabric loops 54 stitched to the front panel 42 of the pack 22. The s-shape of the aluminum bars 52 allows a close fit with the user 30 by approximating the shape of a human back from the buttocks to the small of the back (the lumbar region), past the thoracic region, over the shoulder blades, and upward therefrom.

As seen in FIGS. 2, 3, and 5, the upper pad 26 is stitched to the front panel 42 of the pack 22 in position to enclose the central portion of each of the aluminum bars 52 between the upper pad 26 and the pack 22. The upper pad 26 has an outer surface 56 composed of a mesh material to allow the surface to be breathable and to quickly dry should it become damp due to perspiration from the user's back.

The lower or lumbar pad 28, as seen in FIGS. 2, 3, and 5, is mounted on a relatively rigid, plastic plate 58 connected to lower ends of the aluminum bars 52 and stitched to the front panel 42 of the pack 22. A pair of vertically-extending loop strips (as a part of a pile and loop releasable connector) are installed on the outer surface of the plastic plate 58 which backs the lumbar pad 28. The strips are attached to the plastic plate 58 for approximately half of their length. A remaining free halve 62 of each strip can be folded back to engage with the waistbelt system 38 which can then be sandwiched or held between the two folded halves of each loop strip. A downwardly-extending locking strap 63 attached to the bottom panel 48 includes a releasable connector for engaging with the lumbar pad 28.

Shoulder Strap System

The shoulder strap system 32, best shown in FIG. 3, includes two straps with each anchored at an upper end 64 thereof to the pack 22 at a point between the front panel 42 of the pack 22 and one of the aluminum bars 52 of the frame 24 near the upper end of the pack 22. A lower end 66 of the shoulder strap system 32 is attached to the waistbelt system 38. Each shoulder strap of the system includes several different sections. Proceeding from top to bottom, the first section is a relatively short fabric strap 68 which is stitched to the pack 22 at the upper end 70 of the strap 68. At a free end 72 of the relatively short strap 68 is a plastic buckle 74 which mates with a relatively long, flexible, fabric strap 76 which passes between the upper pad 26 and the pack 22 and through a plastic or metal loop 78 stitched to the pack at the point of connection with the lumbar pad 28. The relatively long, flexible strap 76 is stitched to a relatively rigid, plastic torso plate 80 which is located between the upper pad 26 and the pack 22. The torso plate 80 is also stitched to a first end 82 of a relatively wider and thicker, padded section 84 of the shoulder strap. At a second end 86 of the padded section 84 of the strap, a plastic buckle 88 is provided to engage with a lower adjustment strap section 90 of the shoulder strap system 32. A terminal end 92 of the lower adjustment strap section 90 is stitched to the waistbelt system 38 and a free end 94 is provided for adjustment of the strap relative to the buckle 88.

Figure 4A:
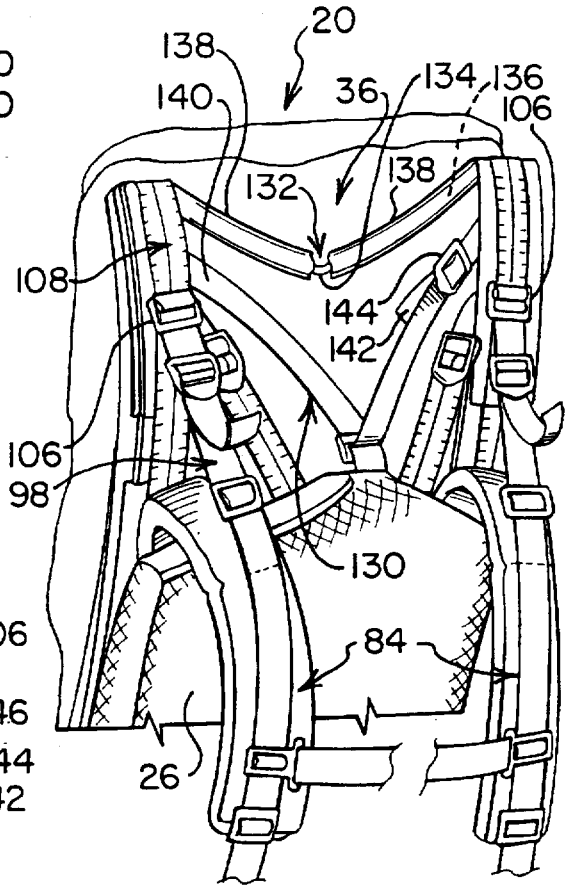
FIG. 4A is an enlarged perspective view of the backpack of FIG. 1 showing the adjustable shoulder strap system of the present invention adjusted for a relatively smaller user.
Figure 4B:
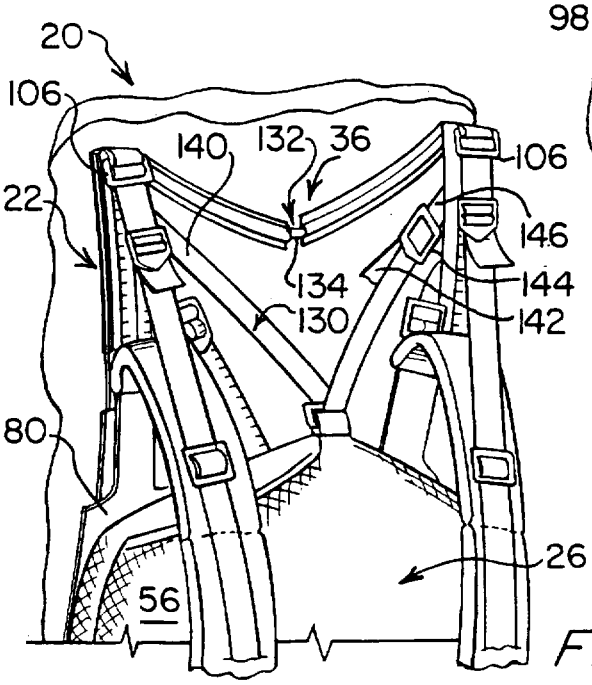
FIG. 4B is an enlarged perspective view of the backpack of FIG. 1 showing the adjustable shoulder strap system of the present invention adjusted for a relatively larger user.

A shoulder pad lift subsystem 96, shown in FIGS. 4A and 4B, is provided to lift the padded section 84 of the shoulder strap off of the top of the user's shoulder 34 by a distance of approximately one-half inch. The intent is to prevent the weight of the backpack 24 and its load carried therein (not shown) from pulling down on the top of the user's shoulder and instead to transfer the weight to the user's hip region 40. The padded section 84 of the shoulder strap will remain snugly in contact with the front side of the shoulder, however. A shoulder pad lift strap 98 of the subsystem 96 is anchored at a lower end 100 to a central portion 102 of the padded section 84 of the shoulder strap system 32 and at an upper end 104 to a sliding buckle or connector 106 on a flexible strap 108 attached to the upper end of each of the aluminum bars 52 of the frame 24. A terminal end 110 of the flexible strap 108 is stitched to the pack 22 at a point adjacent to the upper end of the aluminum bar 52. The flexible strap 108 is stretched vertically along the aluminum bar 52 to a point on the fabric loop 54 attaching the bar to the pack where a locking buckle 112 receives the flexible strap 108 and locks it into position. Located on the flexible strap 108 between its terminal end 110 and the locking buckle 112 is the sliding buckle 106 to which the upper end 104 of the shoulder pad lift strap 98 is attached. The length of the shoulder pad lift strap 98 can be adjusted by pulling a free end 114 of the strap 98 through a buckle 116 attached to the upper end 104 of the strap. The shoulder strap system 32 includes an indexed scale 118 provided on the flexible strap 76 for adjusting the shoulder strap to a length appropriate for the particular height of the user 30. The scale 118 is provided by a strip of tape 120 stitched to the flexible strap 76. The left side of the outer surface of the tape strip 120 contains markings or indicia 122 corresponding to the body height of the user 30 in both inches and centimeters. The right side of the strip of tape 120 contains markings or indicia 124 corresponding to the torso height of the user 30 in both inches and centimeters. Thus, the user, or any other person, can adjust each of the flexible straps 76 relative to their respective buckles 74 until the marking 122 representing the standing height of the user appears adjacent to each buckle. Each shoulder strap should then be correctly positioned for the user. For users who have a long or short waist or torso, the right side of the scale representing torso height can be used to properly adjust the shoulder straps.

Similarly, a tape strip 126 is stitched to the flexible strap 108 of the shoulder strap lift subsystem 96. Body height and torso height markings or indicia 128 are provided on this tape strip in both inches and centimeters. After the shoulder strap length has been properly adjusted, the proper angle of the shoulder strap lift subsystem 96 can be adjusted by positioning the sliding buckle 106 to the appropriate position on the flexible strap 108 containing the tape strip 126 with the height indicating information. In this manner, each of the shoulder straps can be properly adjusted by untrained personnel.

Shoulder Width-Adjustment System

The shoulder width-adjustment system 36, shown in FIGS. 2, 4A, and 4B, includes a strap 130 for limiting the distance that the upper portions of the aluminum bars 52 of the frame 24 may be spaced apart and also includes a spring 132 for urging the aluminum bars of the frame away from each other and also for providing additional headroom for the user 30. The spring is an elongated delrin rod 132 formed at an obtuse angle, defining a relaxed position. When the rod 134 is bent further toward a right angle position, the spring-like nature of the red will exert a force attempting to "straighten-out" toward the relaxed position. The rod 134 is received within a channel 136 formed by a pair of strips of fabric 138 stitched in a v-shape to an upper portion of the pack 22. The inner ends of the fabric strips 138 at the apex of the "v" are not stitched to the pack 22, leaving the central portion of the rod 134 exposed. The shape of the spring also serves to indent the pack 22 in the adjacent area thereof to create mere headroom for the user 30 which may be particularly useful if the user is wearing a helmet.

The adjustment strap 130 is a relatively long, flexible strap with a terminal end 140 stitched to the upper portion of the backpack adjacent one of the aluminum bars 52 and with a free end 142 engaged in a plastic buckle 144 attached to a relatively shorter, flexible strap 146 stitched to the upper pack adjacent to the other aluminum bar. Thus, the free end 142 of the adjustment strap 130 can be pulled through the buckle 144 to shorten the strap and pull the aluminum bars 52 closer together and thus decrease the width of the backpack frame 24. Alternatively, the buckle 144 can be manipulated to lengthen the adjustable strap 130 so as to allow the spring 132 to bias the aluminum bars outward to increase the shoulder width of the backpack frame 24. Ultimately, the maximum shoulder width of the backpack frame 24 is limited by the fabric of the pack 22 to which the frame 24 is stitched, as previously described.

Waistbelt system

The waistbelt system 38, shown in FIGS. 3, 5, 6, 7, and 8, includes a waistbelt assembly 148 and a pair of hip cushions 150 attached to the waistbelt system 38 in such a manner as to allow the cushions 150 to float so as to move a limited amount relative to the waistbelt assembly 148. The waistbelt assembly 148 includes a relatively wide semi-rigid plastic strap 152 having an inner side 154 and an outer side 156. The central portion of the plastic strap 152 is attached to the plastic plate 58 of the lumbar pad 28 by strips of pile material 158 of a releasable connector attached to both the inner side 154 and outer side 156 of the plastic strap. The strips are sized and positioned to mate with the previously described "loop" strips of the releasable connector stitched to the plastic plate of the lumbar pad 28. The plastic strap 152 may be positioned at the desired height on the lumbar pad 28 with the strips of "pile" on the inner surface of the plastic strap 152 mating with, the strips of "loop" stitched to the plastic plate 58 of the lumbar pad 28. The free halves 62 of the loop strips may be folded over and engaged with the pile material 158 on the outer side 156 of the plastic strap 152. The downwardly-extending locking strap 63 attached to the bottom panel 48 of the pack 22 can then be folded over the lumbar pad 28 so that the mating portions of the releasable connectors engage and securely hold the waistbelt system 38 in place relative to the lumbar pad 28.

Figure 7:
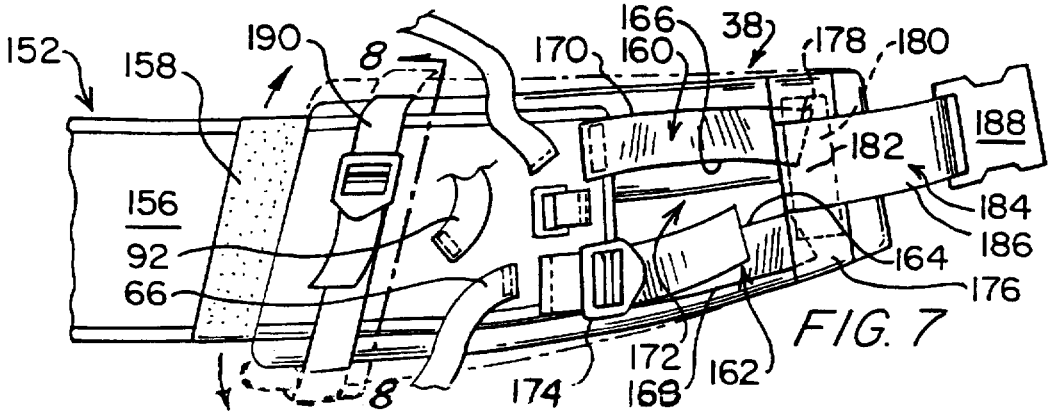
FIG. 7 is an enlarged front elevation view of a portion of the waistbelt shown in FIG. 6 showing the possible relative movement of different sections of the waistbelt.

At both of the two ends of the elongated plastic strap 152 a pair of flexible horizontal straps 160 and 162 are attached thereto, as seen in FIG. 7. The upper strap 160 is fixed in length while the lower strap 162 includes an adjustment buckle 174 for adjusting the length thereof. The straps extend longitudinally in a spaced apart relationship. An upper edge 164 of the lower strap 162 and a lower edge 166 of the upper strap 160 are adjacent edges and a lower edge 168 on the lower strap and an upper edge 170 on the upper strap are opposite edges. Each strap is twisted slightly about a transverse axis before stitching so that each end thereof is not quite parallel with the opposite end. This results in the adjacent edges having an excessive length relative to the width of the spacing between the ends so that the adjacent edges puff out slightly. In other words, the ends of the strap 162 are closer together along the adjacent edges than at the opposite edges. Similarly, the ends of the strap 160 are closer together along the adjacent edges than at the opposite edges. Thus, the arrangement of each strap is such that the adjacent edges of each strap are relatively longer than the opposite edges of each strap. This puffed-out effect creates a pressureless cup or pocket 172 between the straps which can receive the user's hipbone to decrease the direct pressure of the waistbelt system 38 on the hipbone and increase the comfort of the user.

The two longitudinally-extending straps 160 and 162 on both sides of the waistbelt assembly 148 are stitched to a relatively shorter vertical strap 176 provided on each of both sides of the waistbelt assembly. The vertical strap 176 includes a vertically extending pocket 178 defined therein which receives an aluminum bar 180. Attached to the vertical strap 176 is a terminal end 182 of a belt strap 184 which is looped at a free end 186 through a portion of a belt buckle 188. The opposite side of the waistbelt assembly 148 includes the corresponding half of the belt buckle 188. Thus, when the waistbelt assembly is attached to the waist or the hips 40 of the user and fastened together, the force exerted by the belt strap 184 is applied to the aluminum bar 180 which spreads the force across both of the horizontally extending straps 160 and 162. Also, the rigidity of the bar 180 and of the plastic strap 152 serves to spread and create the pocket 172. Thus, the combination of the space between the straps, the pouched nature of the straps, the aluminum bar 180, and the plastic strap 172 combine to form the pocket 172 for receiving the hip bone.

Each hip cushion 150 is attached to the waistbelt assembly 148 at two points. First, the vertical strap 176 is stitched at either end to the hip cushion 150. Thus, movement of the central portion of the vertical strap 176 relative to the hip cushion 150 is possible, allowing some movement of the hip cushion relative to the waistbelt assembly. The hip cushion is also retained on the waistbelt assembly by an adjustable strap 190 forming a loop along an outer side 192 of the hip cushion and slidably receiving the plastic strap 152. The hip cushion 150 may preferably include an area 191 (FIG. 3) of stretchable material adjacent the user's hipbone. This area 191 further helps to define the pocket 172 by allowing the cushion 150 to partially deform into the pocket 172. This feature is particularly important when the user is carrying loads in the range of sixty-five pounds and greater. Alternatively, the cushion 150 may not include such an area 191 as shown on the opposite hip cushion on FIG. 3.

Figure 9:
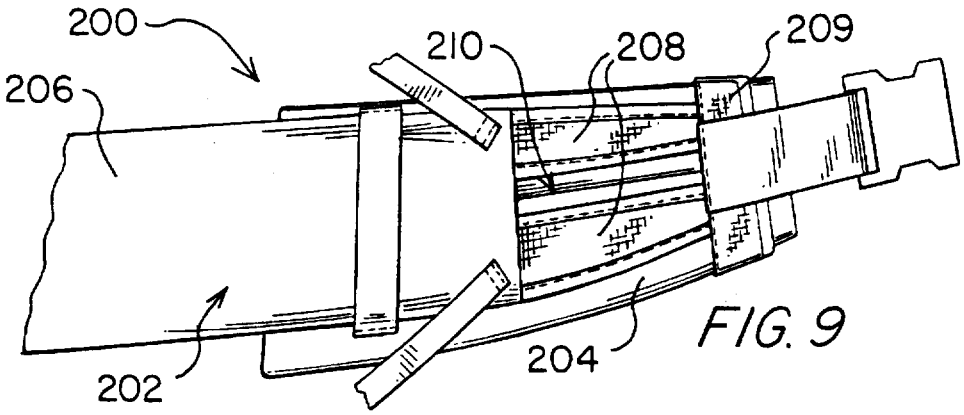
FIG. 9 is an enlarged front elevation view of a portion of the waistbelt shown in FIG. 6 showing a second embodiment of the waistbelt.

A second embodiment of a waistbelt system 200, shown in FIG. 9, includes a waistbelt assembly 202 with a hip cushion 204. The waistbelt assembly 202 includes a plastic strap 206 from which a pair of parallel, longitudinally extending spaced apart straps 208 extend. The straps 208 connect to a vertical strap 209 stitched at either end to the hip cushion 204. The space between the straps 208 helps to form a hipbone pocket 210.

Figure 10:
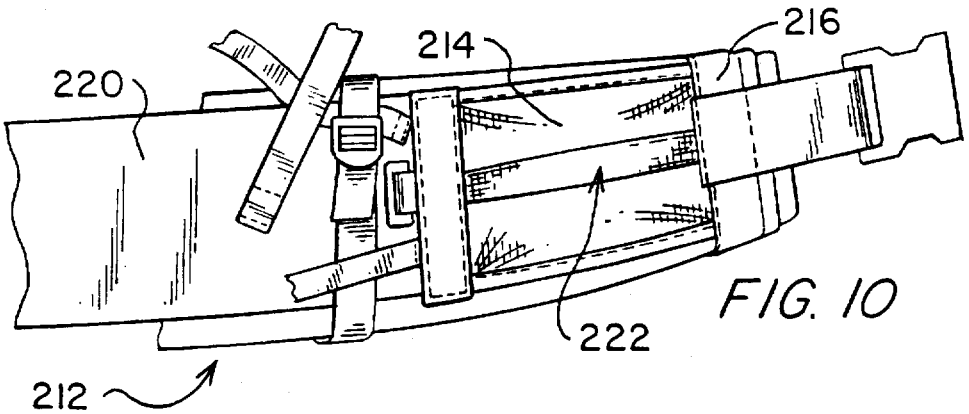
FIG. 10 is an enlarged front elevation view of a portion of the waistbelt shown in FIG. 6 showing a third embodiment of the waistbelt.

A third embodiment of a waistbelt system 212, shown in FIG. 10, includes a pleated sheet 214 extending between a vertical strap 216 containing an aluminum bar (not shown) and a plastic strap 220. The pleating in the sheet 214 helps to form a hipbone pocket 222.

Figure 11:
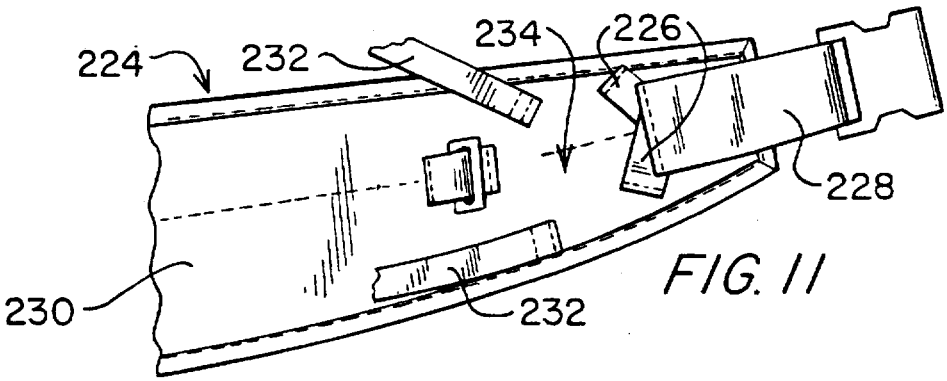
FIG. 11 is an enlarged front elevation view of a portion of the waistbelt shown in FIG. 6 showing a fourth embodiment of the waistbelt.

A fourth embodiment of a waistbelt system 224, shown in FIG. 11, includes a pair of diagonal straps extending out from a belt fastening strap 228. These straps 226 attach to a main waistbelt 230 to which two load straps 112 from the central portion of the backpack (not shown) attach at a spaced-apart relationship. The relative positioning of the attachment points of the-straps 226 and 232 form a hipbone pocket 234.

Figure 12:
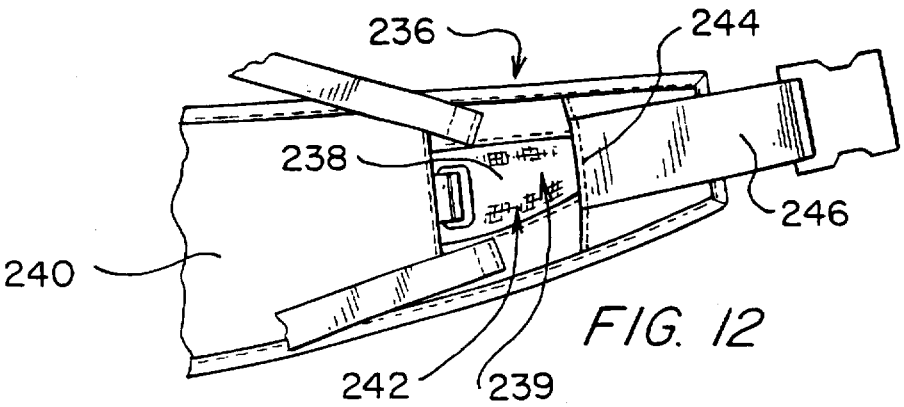
FIG. 12 is an enlarged front elevation view of a portion of the waistbelt shown in FIG. 6 showing a fifth embodiment of the waistbelt.

A fifth embodiment of a waistbelt system 236, shown in FIG. 12, includes a flexible, stretchable material 238, such as neoprene, at an area 239 on a main waistbelt 240 which forms the hipbone pocket 242. The area 239 is an approximately rectangular opening defined in the waistbelt 240 to receive the stretchable material 238. A curved seam 244 is utilized on one side of the approximately rectangular opening where a belt buckle strap 246 connects to the neoprene stretchable material 238 and to the main waistbelt 240. The combined geometry of the curved seam 244 and the point of intersection of the belt buckle strap 246 with the main waistbelt 240 so that the non-stretchable portion of the waistbelt on either side above and below the stretchable material only intersects with a small amount of the belt buckle strap 246 on its outside edges serves to help form the pocket 242.

Figure 13:
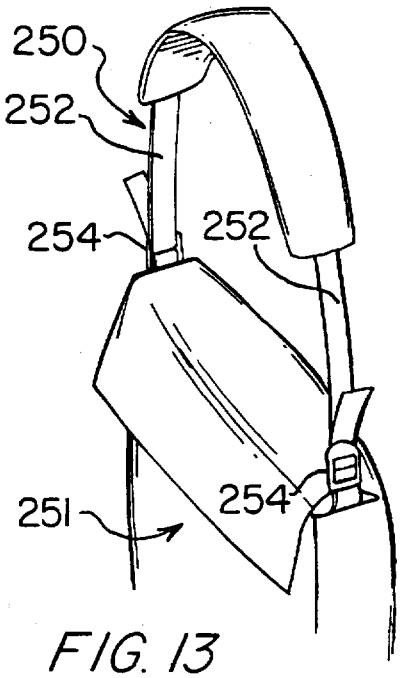
FIG. 13 is a perspective view of a bag with an attached shoulder sling of the present invention.
Figure 15:
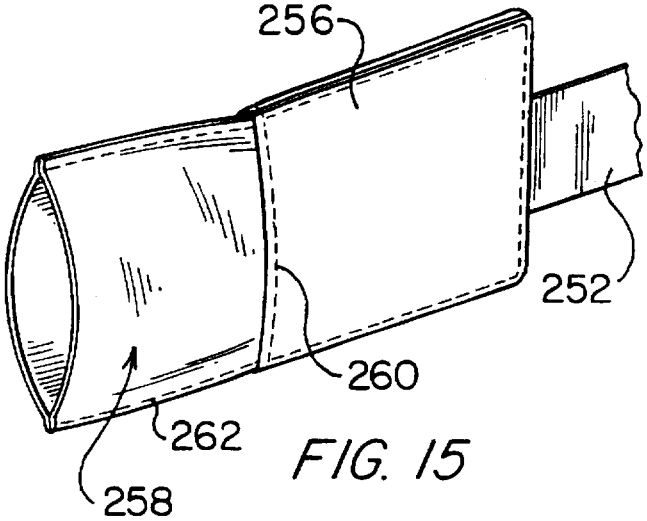
FIG. 15 is a cross-sectional view of the shoulder sling taken along line 15—15 of FIG. 14.
Figure 14:
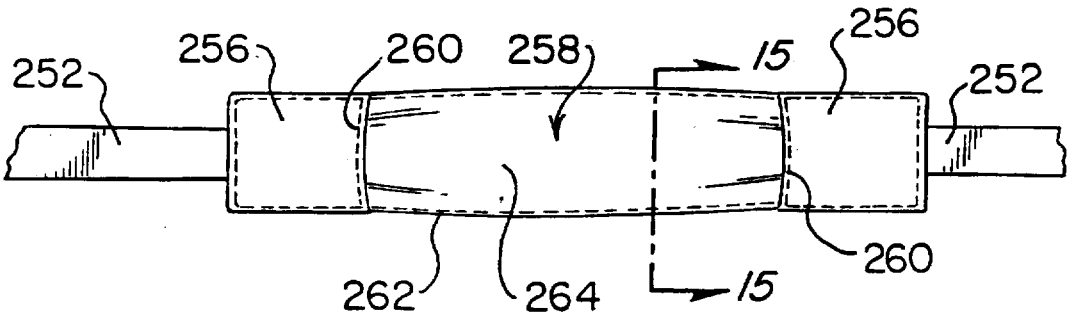
FIG. 14 is a bottom view of the shoulder sling shown in FIG. 13.

Shoulder sling an optional shoulder sling 250, as shown in FIGS. 13–15, is provided for carrying a bag 251 on the user's shoulder. The sling 250 includes straps 252 attached to buckles 254 on the bag 251. The sling 250 also includes a fabric section 256 at the end of each strap 252. A stretchable section 258 connects the two fabric sections 256. A curved seam 260 is employed to connect the stretchable section 258 to each fabric section 256. A pair of relatively less stretchable side seams 262 extends along the length of the stretchable section 258. The stretchable section 258 includes an abundance of material in the vertical direction as seen on FIG. 14. Thus, as can be seen in FIG. 15, the material bows out due to the manner in which it is bunched along the curve seam 260. The combination of the stretchable characteristic and the abundance of material of the section 258, the curved seam 260, and the relatively less stretchable side seams 262 help to define a pocket 264 on the shoulder sling 250 which receives the user's shoulder and distributes pressure more evenly thereon.

The waistbelt system 38 of the present invention provides at least the following advantages. The hip pocket 172 formed between the two horizontal straps 160 and 162 reduces direct pressure on the user's hip directly adjacent to the hipbone and thus reduces discomfort. The hip cushion 150 can move relative to the waistbelt assembly 148 allowing the hip cushion to remain substantially fixed relative to the user's body while the waistbelt assembly, which is attached directly to the backpack, may shift back and forth as the load in the backpack shifts due to movement of the user. The adjustment buckle 174 on each of the lower straps 162 of the two horizontally extending straps allows the waistbelt system to be tilted away from a vertical position to allow the waistbelt system to properly fit with a user's hips which may vary in shape. Because the tilt adjustment arises from the position of a strap relative to a buckle, the number of the positions is infinite so as to allow for the proper fit. Lastly, vertically extending aluminum bar 180 in the vertical strap 176 and the plastic strap 152 of the waistbelt assembly 148 helps to form the above-described pocket 172 by diverting the pressure from the relatively narrower belt strap 184 to the relatively wider distance spanned by the aluminum bar. Indeed the forces are spread ultimately to the outer edges of the hip cushions 150.

The foregoing is considered illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to as falling within the scope of the invention as defined by the claims which follow.

The invention claimed is:

1. A backpack for wearing on the back of a user comprising;

a pack;

a waistbelt operatively connected to the pack including two weight-bearing portions of the waistbelt which are attached to the waistbelt to define a gap between the two weight-bearing portions to create a pocket to receive the hipbone of the user to relieve pressure of the waistbelt on the hipbone, wherein the waistbelt includes a pair of longitudinally-extending, vertically spaced-apart straps, one being an upper strap and one being a lower strap, each strap having an upper and a lower side edge and further wherein the lower edge of the upper strap is attached so as to be longer than the upper edge of the upper strap and the upper edge of the lower strap is attached so as to be longer than the lower edge of the lower strap to define the pocket between the two straps.

2. A backpack as defined in claim 1 wherein the length of the lower strap is adjustable to allow the waistbelt to be tilted relative to the pack and to the user for precise adjustment of the waistbelt on the hips of the user.

3. A backpack for wearing on the back of the user by fastening about the hips of the user, comprising:

a pack; and a waistbelt operatively connected to the pack including:

a central portion having a right end and a left end;

a first side portion including a first pair of longitudinally-extending, vertically spaced-apart straps, each strap having a first end and a second end wherein one of the straps is adjustable in length, with the first end of each strap attached to the right end of the central portion, the adjustment in length of the one vertically spaced-apart strap providing the ability to adjust the tilt of the first side portion of the waist belt relative to the central portion of the waistbelt;

a second side portion including a second pair of longitudinally-extending, vertically spaced-apart straps, each strap having a first end and a second end wherein one Of the straps is adjustable in length, with the first end of each strap attached to the left end of the central portion, the adjustment in length of the one vertically spaced-apart strap providing the ability to adjust the tilt of the second side portion of the waistbelt relative to the central portion of the waistbelt; and a belt fastener attached to the second ends of the first and second pair of straps to allow the first and second side portions of the waistbelt to be attached together.

4. A backpack as defined in claim 3 wherein the adjustable straps are adjustable to a variable number of lengths.

5. A backpack for wearing on the back of a user, comprising;

a pack having an upper portion and a lower portion wherein the upper portion includes a pair of shoulder strap support members;

a pair of shoulder straps each operatively connected between the lower portion of the pack and one of the pair of shoulder strap support members;

an adjustment strap interconnecting the pair of shoulder strap support members to limit the distance which the shoulder strap support in members can be separated from each other, wherein the adjustment strap is adjustable in length; and means operatively interconnecting the pair of shoulder strap support members for biasing the members away from each other to the extent allowed by the adjustment strap;

wherein the pack is made of fabric stitched to the pair of shoulder strap support members and further wherein the fabric provides a maximum limit for the extent to which the shoulder strap support members may be biased away from each other.

6. A backpack for wearing on the back of a user comprising;

a pack; and a waistbelt operatively connected to the pack including two weight-bearing portions of the waistbelt which arc attached to the waistbelt to define a gap between the two weight-bearing portions to create a pocket to receive the hipbone of the user to relieve pressure of the waistbelt on the hipbone;

wherein the waistbelt further includes a vertically-extending stiffener connected to the waistbelt at a location along the pocket to assist in holding the pocket open in a vertical dimension and to transfer forces from the load of the backpack to points above and below the pocket.

7. A backpack, for wearing on the back of a user, comprising;

a pack; and a waistbelt operatively connected to the pack including two weight-bearing portions of the waistbelt which are attached to the waistbelt to define a gap between the two weight-bearing portions to create a pocket to receive the hipbone of the user to relieve pressure of the waistbelt on the hipbone;

wherein the waistbelt includes a pair of longitudinally-extending, vertically spaced-apart straps, one being an upper strap and one being a lower strap, each strap having an upper and a lower side edge and further wherein the lower edge of the upper strap is attached so as to be longer than the upper edge of the upper strap and the upper edge of the lower strap is attached so as to be longer than the lower edge of the lower strap to define the pocket between the two straps;

wherein the waistbelt further includes a vertically-extending stiffener connected to the waistbelt at a location along the pocket to assist in holding the pocket open in a vertical dimension and to transfer forces from the load of the backpack to points above and below the pocket, particularly to the upper and lower straps.

8. A backpack as defined in claim 7, wherein the stiffener includes an aluminum bar.

9. A backpack, for wearing on the back of a user comprising;

a pack;

a waistbelt operatively connected to the pack including a pocket defined in the waistbelt to receive the hipbone of the user to relieve pressure of the waistbelt on the hipbone, wherein the waistbelt includes a pair of longitudinally-extending, vertically spaced-apart straps, one being an upper strap and one being a lower strap, each strap having an upper and a lower side edge and further wherein the lower edge of the upper strap is attached so as to be longer than the upper edge of the upper strap and the upper edge of the lower strap is attached so as to be longer than the lower edge of the lower strap to define the pocket between the two straps.

10. A backpack as defined in claim 9 wherein the length of the lower strap is adjustable to allow the waistbelt to be tilted relative to the pack and to the user for precise adjustment of the waistbelt on the hips of the user.

* * * * *